US006078132A

United States Patent [19]

Davenport

[11] Patent Number: 6,078,132

[45] Date of Patent: Jun. 20, 2000

[54] MINIATURE DEUTERIUM ARC LAMP

[75] Inventor: Eric P. Davenport, Van Etten, N.Y.

[73] Assignee: Imaging & Sensing Technology Corporation, Horseheads, N.Y.

[21] Appl. No.: 09/010,248

[22] Filed: Jan. 21, 1998

[51] Int. Cl.[7] ..... H01J 1/88

[52] U.S. Cl. ..... 313/238; 313/243; 313/292; 313/609; 313/637; 313/631

[58] Field of Search ..... 313/238, 243, 313/292, 609, 637, 589, 631

[56] References Cited

U.S. PATENT DOCUMENTS

| | | | |
|---|---|---|---|
| 2,486,829 | 11/1949 | Ewing | 313/292 |
| 2,584,758 | 2/1952 | Stutsman | 313/292 |
| 2,787,723 | 4/1957 | Fehr et al. | 313/292 |
| 2,937,306 | 5/1960 | Millis | 313/292 |
| 3,213,313 | 10/1965 | Miale | 313/292 |
| 4,435,265 | 2/1984 | Fischer et al. . | |
| 4,910,431 | 3/1990 | Witt et al. . | |
| 5,117,150 | 5/1992 | Schwarz et al. . | |
| 5,552,669 | 9/1996 | Ikedo et al. . | |
| 5,594,295 | 1/1997 | Van Gennip et al. | 313/292 |

*Primary Examiner*—Ashok Patel
*Attorney, Agent, or Firm*—Phillips, Lytle, Hitchcock, Blaine & Huber LLP

[57] ABSTRACT

The present invention broadly provides an improvement in a deuterium arc lamp having structure (e.g., anode 27, baffle 28, etc.) mounted on the distal end of an electrical conductor (26) within an elongated tubular glass envelope (21) in spaced relation to the side wall (22) of the envelope. The improvement broadly comprises spacer means (24), such as axially-spaced disk-like first and second members (32, 33), that operatively engage the structure, and that restrain transverse movement of such structure within the envelope.

10 Claims, 1 Drawing Sheet

MINIATURE DEUTERIUM ARC LAMP

TECHNICAL FIELD

The present invention relates generally to the field of gas discharge tubes, and, more particularly, to an improved deuterium arc lamp in which mechanical structure having mass is cantilever-mounted on the distal end of an electrical conductor within a glass envelope.

BACKGROUND ART

Deuterium is a hydrogen isotope of mass 2, and is commonly identified by the symbol D. Deuterium occurs in nature as a diatomic molecule, or in compounds.

Deuterium arc lamps are known in the prior art, principally because of their ability to generate light in the ultraviolet range. In general, there are three regions of the ultraviolet spectra. These are known as "UVA", "UVB" and "UVC". Deuterium lamps are known to produce light in all three regions, and are therefore commonly used in various spectral analyzers, such as absorption detectors, spectral photometers, spectroscopes, and the like.

Deuterium lamps have an anode and a cathode arranged within an elongated tubular envelope made of glass or ultraviolet-transmissive material. An electron stream is caused to flow from the cathode to the anode. This is shaped by a baffle, and a "ball of fire" is produced adjacent the baffle to generate light in the ultraviolet range. In many cases, the mechanical structure (e.g., anode, baffle, and the like) is cantilever-mounted within the glass envelope on the distal end of one or more electrical conductors. The conductor itself is generally in the form of a rod-like member having a large length-to-diameter ratio, but normally possesses sufficient strength to prevent or restrain axial movement of the mechanical structure within the envelope. In prior art lamps, the stem of the lamp was typically penetrated by several conductors. Some of these were provided to hold mechanical structure in place, and were not required for electrical conduction.

It is normally desired that the aforesaid mechanical structure be spaced centrally within the envelope and away from the side walls of same. If mounted as a cantilever, the mechanical structure may cause the conductor to flex or bend during movement. This is particularly true with a recent advent of portable applications for such spectral analyzers. There is also a drive towards miniaturization of devices employing deuterium lamps, with a concomitant desire to reduce the size of the lamp itself. To the extent that the conductor must be reduced in size, the possibility of flexure of the structure-supporting anode becomes of increasing concern as the rod diameter is further reduced. Moreover, it is pointed out that the mass of the structure supported at the distal end of the conductor is large in relation to the mass of the conductor itself.

Additional details of prior art deuterium lamps are shown in a catalog entitled "Deuterium Lamps and Power Supplies for UV Analytical Instruments", Imaging and Sensing Technology Corporation, Horseheads, N.Y. (undated), and in U.S. Pat. Nos. 4,433,265, 4,910,431, 5,117,150 and 5,552,669. The aggregate disclosures of these various prior art references are hereby incorporated by reference. These references appear to disclose various types of prior art deuterium lamps in which mechanical structures are cantilever-mounted on the distal end of a conductor.

Accordingly, it would be generally desirable to restrain lateral movement of the cantilevered structure so as to avoid unnecessary flexure of the conductor and to permit miniaturization of deuterium lamps and devices employing same.

DISCLOSURE OF THE INVENTION

The present invention provides an improvement for use in deuterium arc lamps.

With parenthetical reference to the corresponding parts, portions or surfaces of the disclosed embodiment, merely for purposes of illustration and not by way of limitation, the present invention broadly provides an improvement for use a deuterium arc lamp (20) having physical structure (e.g., anode 27, baffle 28, dielectric material 29, etc) mounted on the distal end of an electrical conductor (26) within an elongated tubular glass envelope in spaced relation to the side wall (22) of the envelope. The improvement broadly includes spacer means (31) operatively engaging the structure and arranged in closely-spaced facing engagement to the side wall (22) of the envelope to restrain transverse movement of the structure within the envelope.

In the preferred form, the structure includes an anode (26) and a baffle (28). A dielectric material (29) may be operatively interposed between the anode and baffle to maintain the spacing therebetween. Suffice it to say here that such assembled structure has mass which gives rise to the potential problem of flexure of the conductor if such structure is mounted as a cantilever on a distal end of the conductor and the lamp is moved.

In the preferred form, the spacer means includes a disk-like first member (32) having a blind recess arranged to receive one marginal end portion of the anode and baffle, and having an outer cylindrical surface (36) arranged in closely-spaced facing relation to the side wall (22) of the envelope. The first member may be formed of alumina or some other dielectric material, and may have one or more openings (39, 40) to accommodate passage of conductors, to equalize pressure, on opposite sides thereof, and the like.

In the preferred form, the spacer means also includes a disk-like second member (33) arranged in longitudinally-spaced relation to the first member. The second member also has a blind recess (44) arranged to receive the other marginal end portion of the anode and baffle. A cathode (45) may be positioned adjacent the second member, and the second member may be provided with an arcuate slot-like through-opening (50) to accommodate passage of an electron stream (E) from the cathode to the anode. The second member may also be formed of alumina or the like, and may have an outer cylindrical surface (43) in closely-spaced facing relation to the glass envelope. A tubular shield (49), preferably made of nickel, may have one marginal end portion connected to the second member, and may extend longitudinally away therefrom in closely-spaced facing relation to the envelope side wall (22) so has to provide a radial shield about the cathode.

Accordingly, the general object of the invention is to provide an improved deuterium arc lamp.

Another object is to provide an improvement for use in a deuterium arc lamp, that will satisfactorily address the problem of a large-mass cantilevered structure mounted on the distal end of a long slender electrical conductor.

Another object is to provide an improvement for use in a deuterium arc lamp, that will allow further miniaturization of such lamps and devices employing same.

Another object is to reduce the number of conductors that sealingly penetrate the stem of a deuterium lamp to only that number needed for electrical conduction.

These and other objects and advantages will become apparent from the foregoing and ongoing written specification, the drawings, and the appended claims.

DESCRIPTION OF THE PREFERRED EMBODIMENTS

Figure 1:
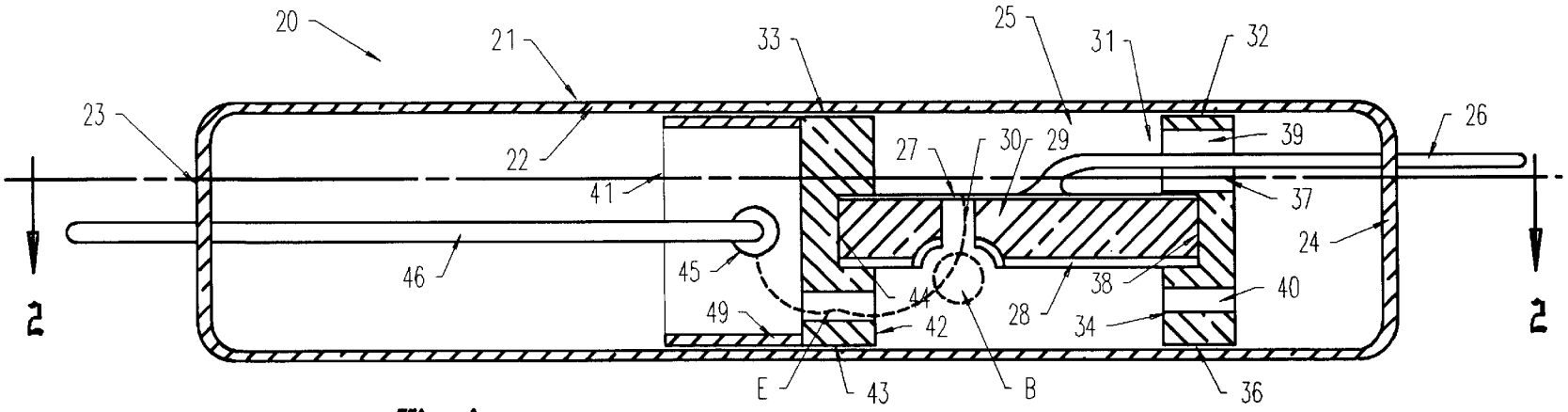
FIG. 1 is a longitudinal vertical sectional view of an improved deuterium lamp according to the present invention, this view showing the cantilevered structure as being supported by the first and second members, and further showing the cathode shield as extending longitudinally from the second member.
Figure 2:
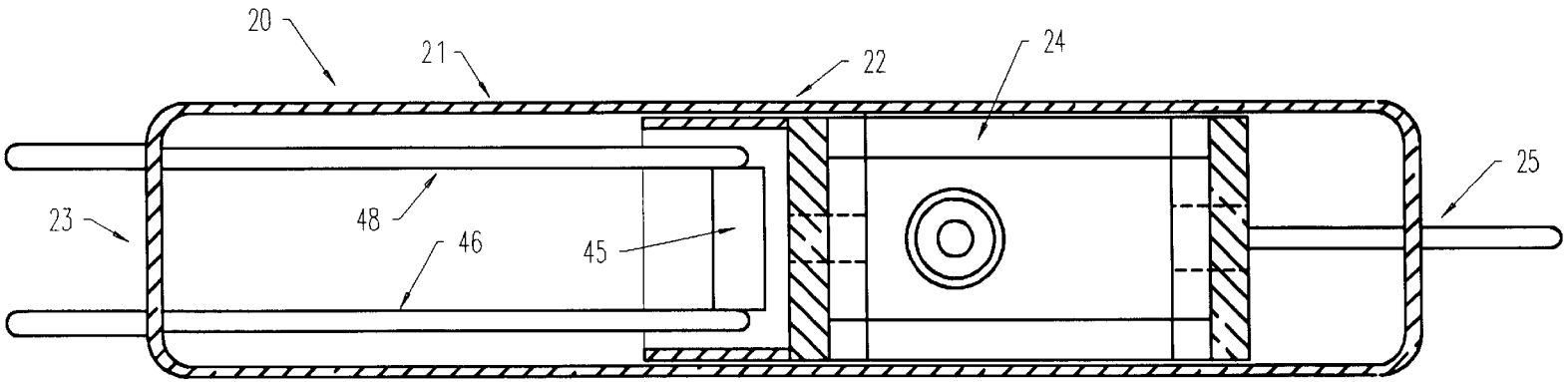
FIG. 2 is a longitudinal horizontal sectional view thereof, taken generally on line 2—2 of FIG. 1.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention broadly provides an improved deuterium arc lamp, of which a presently-preferred form is generally indicated at 20.

The improved arc lamp is shown as having a horizontally-elongated tubular glass envelope 21 that includes a cylindrical side wall structure 22, a vertical left end wall 23, and a vertical right end wall 24. Envelope 21 is formed integrally, and the end walls are hermetically sealed to the side walls. The tube is evacuated to a few torr, but contains deuterium gas in the desired amount.

A physical structure, generally indicated at 25, having a mass, is supported on the left marginal end of an electrical conductor 26 that also sealingly penetrates right end wall 24. Conductor 26 is a rod-like member, and its left marginal end portion is joined to a rectangular plate-like anode 27. The anode is transversely spaced from a baffle 28 by means of an intermediate dielectric member, generally indicated at 29. An opening 30 in member 29 provides access through the baffle to the anode.

In prior art devices, the anode, baffle and intermediate dielectric member were simply cantilever-supported on the end of the conductor on which they were mounted. However, in portable devices, the inertia associated with movement could cause flexure of the conductor, with a concomitant swinging or pivotal motion of the structure within the tube.

To accommodate this, the invention includes spacer means, generally indicated at 31. In the preferred form, the spacer means includes a disk-like first member 32 and a disk-like second member 33 spaced longitudinally from the first member. These two disk members may be conveniently formed of alumina or some other suitable dielectric material.

The first member 32 is shown as being a disk-like member operatively arranged within the tube or envelope. More particularly, first member 32 has an annular vertical left face 34, a circular vertical right end face 35, and an outer cylindrical surface 36 arranged in closely-spaced facing relation to the inner wall of the envelope. In some cases, the spacer may be physically attached to the side wall, as by means of a suitable ceramic cement (not shown). A blind recess, generally indicated at 38, extends rightwardly into the first member from its left end face 34 to receive and accommodate the right marginal end portion of the anode, the baffle and the intermediate dielectric member. The first member is also shown as having an opening 39 to accommodate passage of the conductor and insulator 37. A second opening 40 extends through the first member to allow the pressures on other side of the first member to equalize.

In the preferred embodiment, the spacer means includes second member 33. This second member is also shown as being a disk-like member arranged within the glass envelope in longitudinally-spaced relation to first member 32. Second member 33 has an annular vertical left end face 41, a circular vertical right end face 42, and an outer cylindrical surface 43 arranged in closely-spaced facing relation to the inner surface of envelope side wall 22. A blind recess, indicated at 44, extends into the second member from its right end face 42 to accommodate and receive left marginal end portion of the anode, baffle and intermediate dielectric material. Here again, the second member 33 may be closely spaced with respect to the glass envelope, or, alternatively may be suitably cemented to the side wall (as desired).

A cathode 45 is shown as being mounted on the ends of two conductors 46, 48 that penetrate the left end wall of the envelope and extend into the glass envelope. Cathode 45 is shown as being arranged adjacent the left end wall of second member 33. A thin-walled tubular shield 49, preferably formed of nickel, has its right marginal end portion connected to the second member 33, and extends leftwardly therefrom in closely-spaced facing relation to side wall 22 to shield the cathode in a radial direction.

In use, a current flows through the cathode. This causes a stream of electrons, schematically indicated at E, to issue therefrom. These electrons pass through second member opening 50 in the form of a stream, which is shaped by the baffle and is drawn toward the anode. This stream then creates a "ball of fire", schematically indicated at B, adjacent the baffle. This fireball produces light in the ultraviolet range that may be transmitted through the envelope.

Unlike the prior art devices in which the mechanical structure was simply cantilever-mounted on the end of the anode conductor, the improved device has spacer means, such as members 32, 33. These members may be loosely fitted within the envelope, but function to restrain transverse swinging or pivotal movement of such structure when the device is moved in a transverse direction. This lateral restraint reduces the amount of flexure of the anode conductor 25, and will allow miniaturization of the device beyond levels that are currently available.

Modifications

The present invention contemplates that many changes and modifications may be made.

In the foregoing disclosure and in the claims, the term structure is used generally to refer to physical structure having mass. In the preferred form, that structure is shown as including the anode, the baffle and the intermediate dielectric block. In other tubes, the mechanical structure may include additional structure as well. The salient here is that such structure, whatever its composition, has an aggregate mass which is relatively large in relation to the mass and transverse cross-section of the anode conductor. The greater the mass of such structure, the more susceptible the lamp to a swinging or flexural motion when the tube is moved. Hence, the function of the spacer means is to restrain such transverse movement of such structure, while allowing normal operation of the lamp. In this regard, it is felt that the conductor, even if miniaturized, will have sufficient strength to restrain longitudinal movement of such structure, even with the additional mass of the spacer blocks, because such longitudinal movement will act either as a tensile or compressive load on the conductor. The anode conductor is a relatively-long thin rod-like member that is better suited to restrain an axial load than lateral flexure.

If desired, the spacer blocks 32, 33 may be alternatively provided with transverse slots, rather than blind recesses, to receive and accommodate the marginal end portions of the anode, baffle and intermediate dielectric material. Still other types of holding means might also be employed.

Therefore, while a preferred form of the inventive lamp has been shown and described, and several modifications thereof discussed, a person skilled in this art will readily appreciate that various additional changes and modifications may be made without departing from the spirit of the invention, as defined and differentiated by the following claims.

What is claimed is:

1. In a deuterium arc lamp having structure mounted on the distal end of an electrical conductor within an elongated glass envelope in spaced relation to said envelope, said structure including a cathode, an anode and a baffle, the improvement which comprises:

spacer means operatively engaging said structure and arranged in closely-facing spaced relation to said envelope to restrain transverse movement of said structure within said envelope, and wherein said spacer means includes a disk-like first member having a blind recess arranged to receive one marginal end portion of said anode and baffle, and having an outer peripheral surface arranged in closely-spaced facing relation to said envelope.

2. The improvement as set forth in claim 1 and further comprising a dielectric material operatively interposed between said anode and baffle to maintain the spacing therebetween.

3. The improvement as set forth in claim 1 wherein said first member has one opening therethrough to accommodate passage of a conductor.

4. The improvement as set forth in claim 3 wherein said first member has another opening therethrough to allow the pressures on opposite sides of said first member to equalize.

5. The improvement as set forth in claim 1 wherein said first member is formed of alumina.

6. The improvement as set forth in claim 1 wherein said spacer means includes a disk-like second member arranged in longitudinally-spaced relation to said first member, said second member having a blind recess arranged to receive the other marginal end portion of said anode and baffle.

7. The improvement as set forth in claim 6 wherein said anode is positioned adjacent said second member, and wherein said second member has an opening therethrough to accommodate passage of an electron stream from said cathode to said anode.

8. The improvement as set forth in claim 7 wherein said second member is formed of alumina.

9. The improvement as set forth in claim 7 and further comprising a tubular shield having one marginal end portion connected to said second member and extending longitudinally therefrom in closely-spaced facing relation to said envelope to surround said cathode.

10. The improvement as set forth in claim 9 wherein said shield is formed of nickel.

* * * * *